United States Patent [19]

Farnsworth

[11] Patent Number: 4,935,969

[45] Date of Patent: Jun. 26, 1990

[54] METHOD AND DEVICE FOR THE CONTROLLED DISPOSAL OF HUMAN WASTE

[76] Inventor: Orin J. Farnsworth, 652 Peony Drive, Grand Junction, Colo. 81503

[21] Appl. No.: 260,280

[22] Filed: Oct. 20, 1988

Related U.S. Application Data

[63] Continuation-in-part of Ser. No. 127,954, Dec. 2, 1987, abandoned.

[51] Int. Cl.[5] ..... A47K 11/06

[52] U.S. Cl. ..... 4/484; 4/243; 4/661

[58] Field of Search ..... 4/242, 243, 452, 484, 4/661

[56] References Cited

U.S. PATENT DOCUMENTS

| | | | |
|---|---|---|---|
| 442,324 | 8/1882 | Bonamy . | |
| 597,264 | 1/1898 | Conradi, Jr. . | |
| 1,158,142 | 10/1915 | Muller . | |
| 1,236,798 | 8/1917 | White . | |
| 1,293,955 | 2/1919 | Sloan . | |
| 1,440,773 | 1/1923 | Dystra . | |
| 1,462,662 | 7/1923 | Schaefer . | |
| 1,505,067 | 8/1924 | Lahmer . | |
| 1,509,868 | 9/1924 | Harrison . | |
| 1,519,409 | 12/1924 | Lausten . | |
| 1,573,619 | 2/1926 | Lemmer . | |
| 1,673,622 | 6/1928 | Engalitcheff . | |
| 1,744,300 | 1/1930 | Dewaide . | |
| 2,026,235 | 4/1961 | Persichetti . | |
| 3,249,950 | 5/1966 | Wilson . | |
| 3,495,278 | 2/1970 | Peters | 4/484 |
| 3,546,716 | 12/1970 | Laumann . | |
| 3,588,921 | 6/1971 | Nagel . | |
| 3,605,127 | 9/1971 | Dailey . | |
| 4,264,992 | 4/1981 | Tromp . | |
| 4,674,138 | 6/1987 | Lowry . | |
| 4,720,880 | 1/1988 | Barreau . | |
| 4,759,086 | 7/1988 | Booth-Cox . | |

*Primary Examiner*—Charles E. Phillips

*Attorney, Agent, or Firm*—Fields, Lewis, Pittenger & Rost

[57] ABSTRACT

A method and device for the sanitary disposal of human waste are disclosed. The method includes completely covering the seat and toilet bowl interior of a toilet with a toilet flushable, human waste disposal means to contain viruses and bacteria in the toilet bowl and prevent a toilet occupant from contacting the toilet seat and bowl interior. The method further includes discharging waste into the disposal means, covering the disposal means and flushing both the disposal means and waste matter with minimum bathroom contamination. The disposal means includes a toilet seat cover means having a central cutout portion and a waste collecting means which depends therefrom. Thus, an imperforate barrier isolates the toilet bowl interior when the device is installed on a toilet prevents a toilet occupant from contacting the toilet seat and bowl interior. The collecting means contacts water in the toilet to support the waste and has depending tails at each end to pull the device into the water when the toilet is flushed. Side flanges help support the collecting means on the water and twist the device into a rope-like spiral when the toilet is flushed. A lid has a first open position extending over the front of the toilet bowl to protect the toilet occupant when using the toilet and a second closed position sealing the waste material in the collecting means when the toilet is flushed.

5 Claims, 4 Drawing Sheets

METHOD AND DEVICE FOR THE CONTROLLED DISPOSAL OF HUMAN WASTE

This application is a continuation-in-part of U.S. Ser. No. 127,954, filed Dec. 2, 1987.

TECHNICAL FIELD

This invention relates generally to toilet seat covers, and more particularly, to those of the type which are drawn into the toilet bowl and flushed when the toilet is flushed.

BACKGROUND ART

The prior art is replete with toilet seat covers having water saturable appendages which depend from the seat cover into the water contained in the toilet bowl. When the toilet is flushed, these water saturated appendages all function similarly in that they pull or draw the seat cover into the water being flushed to flush the seat cover down the toilet with the water and waste matter being flushed. In this way, an individual avoids having to touch the seat cover or otherwise dispose of it after using it. This general type of toilet seat cover is disclosed in U.S. Patent Nos. 597,264 to Conradi, Jr.; 1,158,142 to Muller; 1,462,662 to Schaefer; 1,236,798 to White; 1,293,955 to Sloan; 1,440,773 to Dykstra; 1,505,067 to Lahmer; 1,519,409 to Lausten; 1,573,619 to Lemmer; 1,673,622 to Engalitcheff; 1,744,300 to Dewaide; and 4,264,992 to Tromp.

Other types of sanitary covers for toilets, bedpans and the like are shown in U.S. Pat. Nos. 1,509,868 to Harrison; 3,249,950 to Wilson; 3,546,716 to Laumann; 3,605,127 to Dailey; 4,674,138 to Lowry; and 4,759,086 to Booth-Cox.

U.S. Pat. No. 3,588,921 to Negal discloses a combination toilet seat cover and stool specimen collector which is completely enclosed except for a front opening which allows urine to pass directly into the toilet. This combination seat cover and stool collector is primarily used by physicians desiring to collect stool specimens for examination purposes.

U.S. Pat. No. 4,720,880 to Barreau; French Pat. No. 442,324 to Bonamy and West German Pat. No. 2,026,235 to Persichetti each disclose a toilet protective device which covers the sitting surface and extends down into the toilet bowl. However, in each instance the portion extending into the toilet bowl does not come into contact with the water and is generally pointed or constructed at a sharp angle. The difficulty with such a device is that as soon as it becomes saturated with urine or other liquid waste material, it will break through the material and fall into the toilet, if the device is constructed of flushable material. Thus, protection from viruses and bacteria within the toilet bowl is lost. Furthermore, there is no cover to protect the user from the contents of the bowl when the toilet is being flushed. Finally, there is no means provided for pulling the device into the toilet or assuring that it is twisted into a configuration which will pass through the toilet outlet.

Recent studies have demonstrated that many potentially harmful viruses and bacteria exist in toilet bowls. In fact, one study conducted at the Baylor College of Medicine demonstrated that bacteria is shot into the air when a toilet is flushed. The Baylor study also demonstrated that once air-borne, these bacteria are capable of settling on surfaces throughout the bathroom, including surfaces routinely touched by human hands. The results of the Baylor study were reported in the October, 1987 issue of Redbook magazine, in an article entitled "Toilet Training For Adults"; pp. 118–200.

In view thereof, it would be desirable if a toilet seat cover were available that would not only insulate a toilet occupant from the toilet seat, but also insulate the occupant and the bathroom interior from any viruses and bacteria present in the toilet bowl. Furthermore, it is important to protect the toilet occupant, as well as the occupant's clothes from contact with the front of the toilet bowl when using the toilet and to be able to close off the waste material deposited into the device so that viruses and bacteria from the occupant's waste material is not sprayed back up into the bathroom when the toilet is flushed. It would further be desirable if such a toilet seat cover could be flushed down the toilet in a reliable manner so that it would not have to be disposed of otherwise.

DISCLOSURE OF THE INVENTION

The present invention addresses the aforementioned concerns by providing a method and device for the sanitary disposal of human waste. The device of the invention serves as an imperforate barrier between the toilet bowl interior and the bathroom in which the toilet is located. As such, the device isolates the toilet bowl interior, thereby substantially preventing any bacteria and/or viruses in the toilet bowl from being able to leave the bowl and settle on bathroom surfaces when the toilet is flushed. The device also protects the toilet occupant from coming into contact with any viruses and/or bacteria on the toilet seat or from the toilet bowl interior.

The device generally includes a toilet seat cover and a human waste collecting means which sealably depends from a center cutout or open portion defined by the seat cover. As such, the collecting means is attached or sealed about the center cutout portion so that there are no holes either through or between the seat cover and collecting means. Accordingly, when installed on a toilet, the device provides an imperforate barrier between the toilet occupant and the toilet bowl interior, thereby isolating the toilet bowl interior. Any bacteria or viruses in the toilet bowl which may become airborne when the toilet is flushed, now are trapped in the bowl and thus unable to contaminate bathroom surfaces.

The toilet seat cover is sized and configured to cover the toilet seat so as to prevent a toilet occupant from contacting the toilet seat. The center cutout portion defined by the seat cover is sized and configured to permit the passage of human waste discharged by the toilet occupant into the collecting means which, as previously mentioned, depends therefrom. The collecting means also has a rectangular bottom portion which is sized and configured to contact and be supported by water in the toilet bowl.

A preferred embodiment also includes a lid for covering the center cutout portion of the seat cover after the toilet occupant has discharged waste into the collecting means. The lid is of advantage in that it prevents waste matter from coming out of the collecting means when the device is flushed down the toilet. The lid has a second function. It can be folded over the front of the toilet bowl to protect the occupant and the occupant's clothing from contacting the front of the toilet bowl which often becomes contaminated with waste material. The preferred embodiment also includes water saturable tail means attached to the collecting means. The tail means is sized and configured to contact and become saturated with toilet water to help pull the device into the toilet bowl when the toilet is flushed. The preferred embodiment also may include lateral flanges which contact the toilet water and helps support the bottom of the collecting means on the water when waste is being deposited therein. These flanges also help twist the device in response to the action of the swirling water during flushing so that the device is drawn into a loose rope-like spiral for easy passage through the toilet outlet.

The method of the present invention includes completely covering the toilet seat and toilet bowl interior with an imperforate, flushable human waste disposal means so as to: (1) contain any viruses and/or bacteria in the toilet bowl and the waste when the toilet is flushed, (2) prevent the toilet occupant from contacting the toilet seat or the bowl interior and (3) collect human waste matter discharged by the toilet occupant. The method further includes discharging the waste matter into the disposal means and flushing the toilet to dispose of the human waste matter and disposal means.

Additional advantages of this invention will become apparent from the description which follows, taken in conjunction with the accompanying drawings.

BEST MODE FOR CARRYING OUT THE INVENTION

Figure 1:
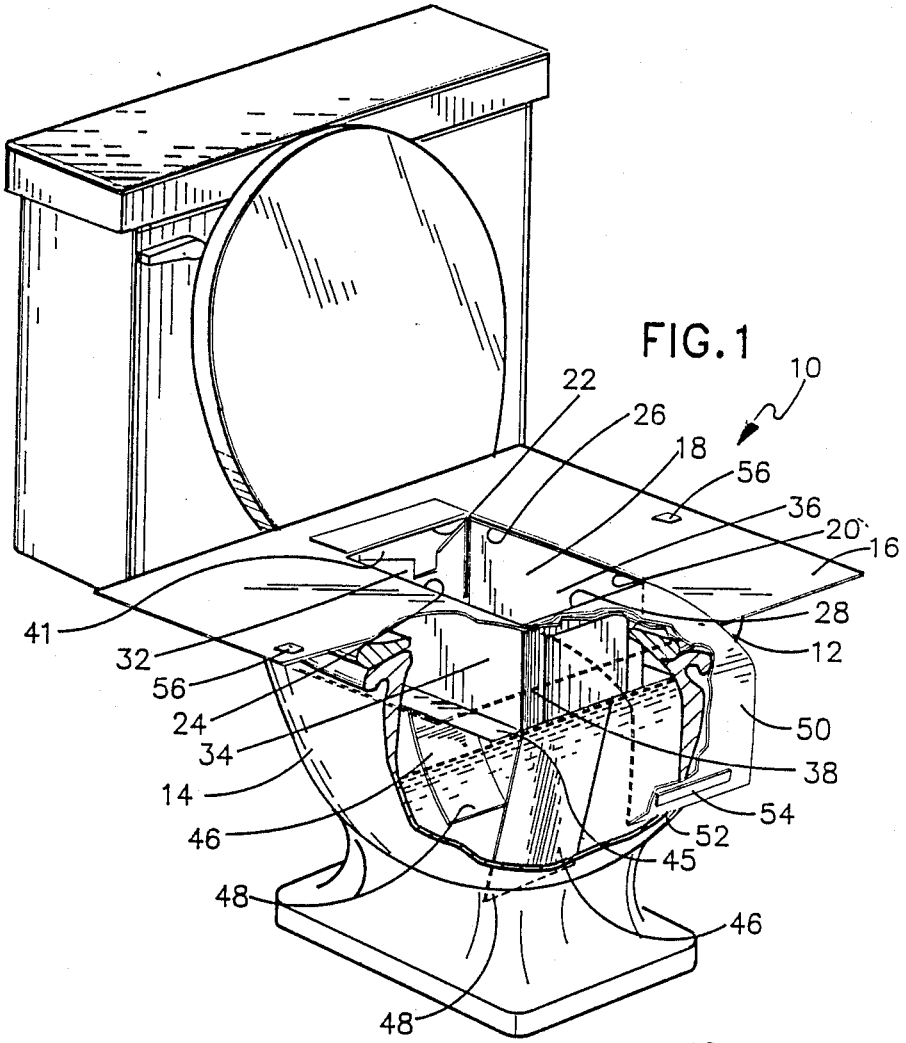
FIG. 1 is a partially broken away, perspective view showing a human waste disposal device of the present invention installed on a conventional toilet.

A sanitary human waste disposal device 10 is illustrated for installation on a toilet seat 12 of a toilet 14. Device 10 generally includes a toilet seat cover or cover means 16 and a human waste collecting means or collector 18 which sealably depends from a cutout portion 20 defined by cover 16.

Seat cover means 16 is sized and configured to cover toilet seat 12 so that an individual sitting on the toilet, i.e., a toilet occupant as used herein, will not contact the toilet seat. Cover 16 is illustrated as being rectangular. However, it could have any shape as long as the selected shape prevents the toilet occupant from contacting the toilet seat.

Cover 16 should also preferably be made from a material having enough weight to support collecting means 18 when the device is installed on a toilet seat, i.e., cover 16 should be heavy enough to prevent the weight of collecting means 18 from pulling the cover down into the toilet prior to flushing of the toilet. The material of cover 16 should also not adhere to the toilet seat. A material which sticks to the seat is quite obviously to be avoided since it would be difficult to remove from the seat. The material should, however, be biodegradable, lightweight and capable of being flushed down the toilet. A suitable material is a lightweight water absorbable or saturable paper such as tissue paper. The paper may be laminated to a suitable plastic layer for added strength or protection, if desired.

Figure 2:
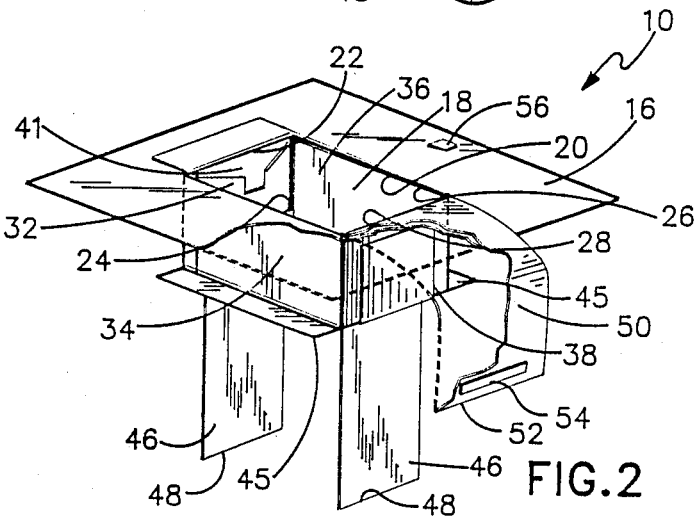
FIG. 2 is a perspective view showing the device illustrated in FIG. 1 in isolation.
Figure 3:
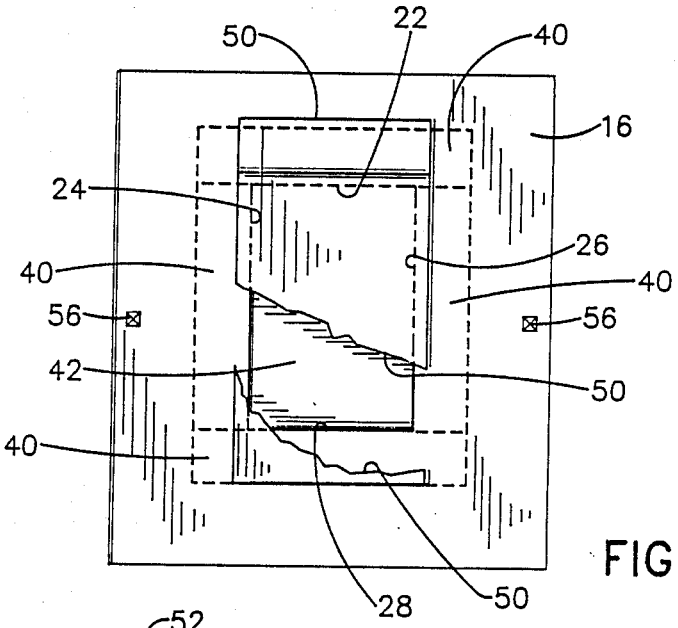
FIG. 3 is a partially cut away, top view of the device of FIG. 2 showing the device with its lid in its closed position covering the device's collecting means.

Turning now to center cutout portion 20, it can be seen in FIGS. 1–3 that cutout portion 20 is rectangularly shaped so as to be defined by four edges; a rear edge 22, side edges 24 and 26 and a front edge 28. Cutout portion is also located generally in the center of cover 16 and is sized and configured to permit the passage of human waste discharged by the toilet occupant. While rectangularly shaped in this embodiment of the invention, cutout portion 20 could also have other shapes, such as an oval shape, as long as the selected shape permits the passage, preferably the unobstructed passage, of both urine and fecal matter from the toilet occupant into collecting means 18. As used herein, human waste or waste matter includes both urine and fecal matter.

Figure 4:
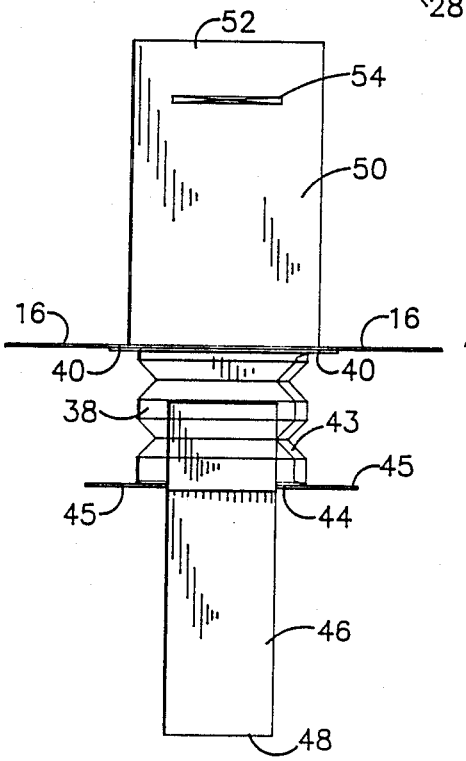
FIG. 4 is a rear view of the device illustrated in FIG. 2.
Figure 5:
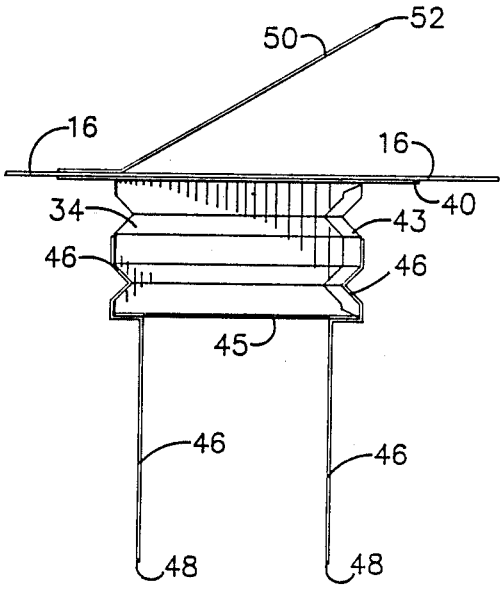
FIG. 5 is a side view of the device illustrated in FIG. 2.

Collecting means 18 is also generally rectangularly shaped and, as such, has four sides; a back side 32, left and right sides 34 and 36, respectfully, and, a front side 38, each of which depends from its associated edge of the cutout portion. As illustrated in FIGS. 3–5, each side also has a flange portion 40 which is secured, preferably glued, to a portion of cover 16 lying adjacent to the side's associated edge to sealably secure collecting means 18 to cover 16. Additional support for collecting means 18 is provided by a tab 41 of cover 16 which depends into collecting means 18 as illustrated in FIGS. 1 and 2, and is preferably glued to the inner facing surface of back side 32.

Figure 8:
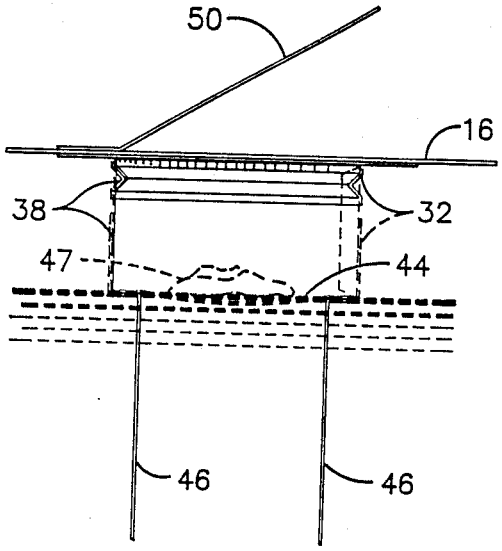
FIG. 8 is a side elevation similar to FIG. 5 but showing how the device is pleated so that it will expand downwardly so as to contact and be supported by the water.
Figure 9:
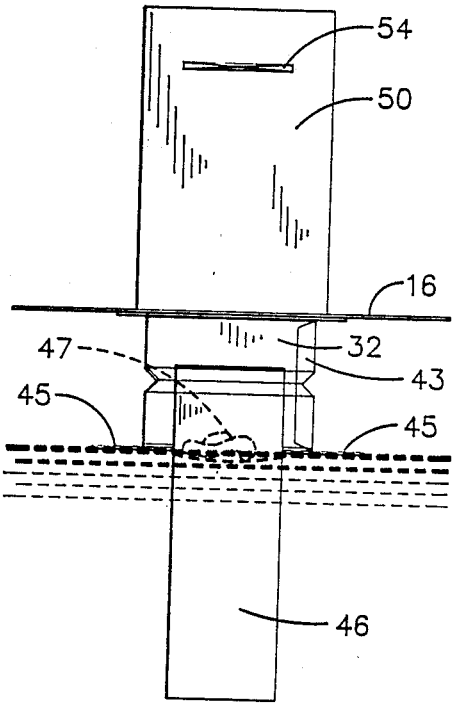
FIG. 9 is a rear view of the device, similar to FIG. 4, but also showing how it expands so that the bottom surface comes into contact with the water.

In FIGS. 3–5, it can be seen that the bottom edges (not numbered) of the sides integrally adjoin a bottom portion 42. Accordingly, it will be appreciated that sides 32 and 38 and bottom portion 42 are preferably cut or stamped from a single blank of material. Sides 32–38 also depend a preselected distance below the plane of cover 16 so that bottom portion 42 is capable of contacting water contained in the toilet bowl. This distance will generally be about 5 inches for most toilets. The sides may be folded or pleated, as best shown in FIGS. 8 and 9, so as to be expanded after insertion of the device in the toilet. In use, the bottom portion will be pushed downwardly a short distance and then when the toilet occupant discharges waste material the waste material will push the bottom on down against the surface of the water due to the unfolding of the pleats or folds in the sides. It will be understood that the word "pleated" as used herein shall refer to any folding of the sidewalls in any manner and is not limited to an accordian-type pleat.

Each side is also provided with a flange portion 43 which is wrapped around and attached, preferably glued, to its respective contiguous side so that the sides are sealed to each other to provide an imperforate collecting means 18. Accordingly, when device 10 is installed on a toilet, collecting means 18 and cover means 16 serve as an imperforate barrier to any bacteria and/or viruses in the toilet bowl interior.

Figure 10:
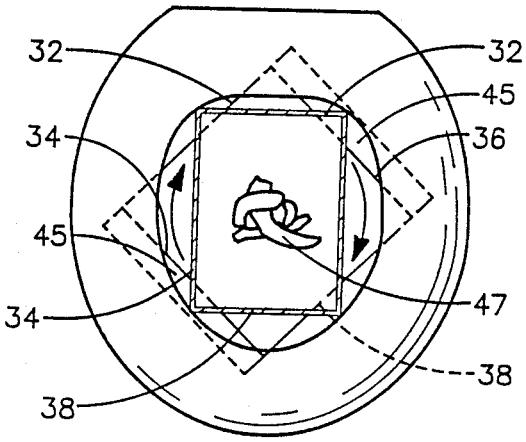
FIG. 10 is a top plan view of a toilet with the toilet seat cover portion of the device removed for clarity of illustration to show the twisting of the device by the swirling water during flushing.

Bottom portion 42 also has a rectangularly shaped bottom cover 44 attached to it, preferably by glue. Bottom cover 44 is sized and configured to have outwardly extending wing portions 45 which extend outwardly beyond sides 34 and 36, respectfully. Wing portions 45 serve to increase the bottom portion's surface area to support the bottom portion on the water in the toilet. When the water is swirling in a circular motion during flushing, the wing portions 45 tend to be carried in the circular motion with the water applying a torque on the device so that it is twisted into a loose rope-like spiral to facilitate its passage through the toilet outlet. In other words, the heavy waste material will be mostly at the center of the device and the wing portions will begin to rotate during flushing thereby twisting the device about the center portion containing the waste material, so as to draw it into the previously described rope-like configuration which will easily allow its passage through the toilet outlet. This twisting action can best be seen by viewing FIG. 10 wherein the waste material 47 is located primarily at the center of the device 10 and the wings 45 exert a torque causing the device to be twisted in the direction of the arrows. The sides, bottom portion and cover are also preferably made from a water saturable or absorbable material having an affinity for water which further enhances pulling of the device into the water when the toilet is flushed.

Collecting means 18 also is provided with a pair of rectangularly shaped tails 46 which are attached, preferably glued, to rear and front sides 32 and 38, respectfully, and to portions (not numbered) of bottom cover 44 adjacent the sides. The tails are sized and configured to depend downwardly into the water in the toilet so that their ends 48 extend into the center of the vortex or whirlpool of water which rapidly whirls about when the toilet is flushed. By extending the tails into this region, they tend to pull of the device into the water when the toilet is flushed. Moreover, the use of two tails instead of one, further enhances pulling of the device into the water since two tails also help impart a twisting action to the device when the toilet is flushed causes the device to twist off the toilet seat into the rope-like spiral.

The importance and advantage of the foregoing construction cannot be overly emphasized. In most prior art devices the protective cover only covers the seat portion itself and did not provide an enclosed container for receiving the waste material discharged by the toilet occupant. One reason was that the device was too bulky to easily be flushed down the toilet. A second reason was that even if a closed container for receiving the waste material was provided, it would break during usage if made of a material which is lightweight enough to be flushed down the toilet. However, all of these problems are overcome in the present invention by the startling discovery that if the container portion of the device is provided with a flat bottom panel which rests on the surface of the water, the device will not be destroyed upon the deposit of waste material thereon, but rather will be supported by the water, even when the material, such as tissue paper, is used in construction of the device. Furthermore, by providing lateral wing portions 45, the flotation of the bottom portion is enhanced and during flushing these wings create a torque, as described above which twists the device into a spiral rope-like configuration which easily passes through the toilet outlet.

FIGS. 1, 2, 4 and 5 illustrate a rectangularly shaped lid means 50 for covering cutout portion 20. Lid means 50 is sized and configured to cover cutout portion 20 when it is moved from its open portion illustrated in FIG. 1 to its closed position illustrated in FIG. 3. Lid 50 is attached, preferably glued, to an area of cover means 16 lying adjacent to front edge 28 of the cutout portion. Lid 50 is also preferably made from a flexible material such as that from which bottom portion 40 is made so that it can be easily swung or pivoted from its open to its closed position. The lid has been shown as being rectangular but may be any suitable shape which will cover cutout portion 20.

As illustrated, lid 50 has a unique dual function. When in a first open position, as shown in FIGS. 1 and 2, it extends down over the front of the toilet bowl and therefore protects the toilet occupant from contamination by touching this surface of the toilet, which is often contaminated, with their legs or portions of their clothing. In the second closed position, it substantially prevents any viruses or bacteria from being discharged from the waste material into the bathroom during flushing of the toilet.

A front or forward facing edge 52 of lid 50 is provided on its underside surface with an adhesive area 54 which is coated, preferably, with a pressure sensitive adhesive. After the toilet occupant closes lid 50, he or she will press downwardly on the area lid 50 opposite area 54 which will cause area 54 to adhere or stick to an underlying area of the cover (i.e., an area lying adjacent to rear edge 22). This will seal the lid to the cover thereby preventing waste matter having been deposited in the collecting means from escaping or coming out of the collecting means when the device is flushed down the toilet as described above. If desired, additional areas 54 can be provided along the sides of lid 50 to provide additional sealing.

Figure 6:
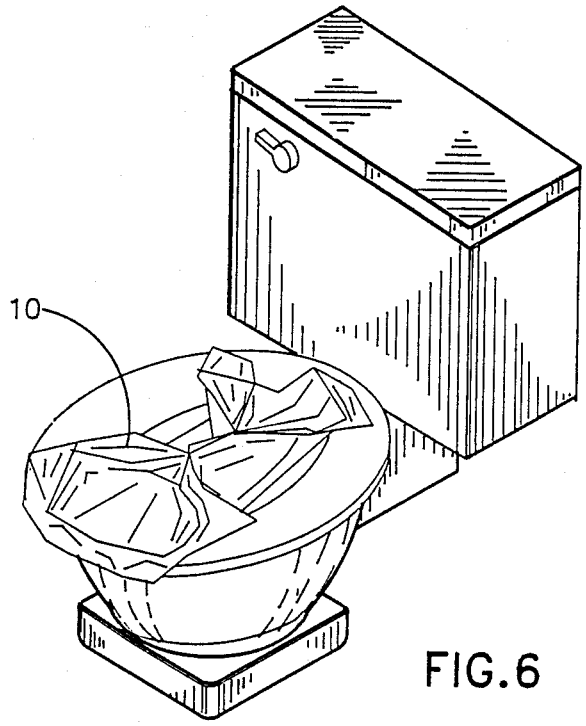
FIG. 6 is a perspective view of the device illustrating sticking of its adhesive areas together to prepare the device for flushing down the toilet.

Optionally, cover means 16 may include a pair of adhesive areas 56 which are also coated with a suitable pressure sensitive adhesive. Areas 56 are preferably located, as depicted, along opposite sides of the cover near the cover's outer edges. An individual can enhance flushing of the device down the toilet after having closed lid means 50 by lifting the edges of the cover adjacent areas 56 off the toilet seat and pressing the areas together as illustrated in FIG. 6 so that they stick to each other. This will partially lift cover 16 off the toilet seat, thereby reducing surface area contact between the cover and toilet seat. With surface area contact reduced, friction between the cover and toilet seat will also be reduced. Accordingly, pulling of the device into the water when the toilet is flushed will be enhanced.

Figure 7:
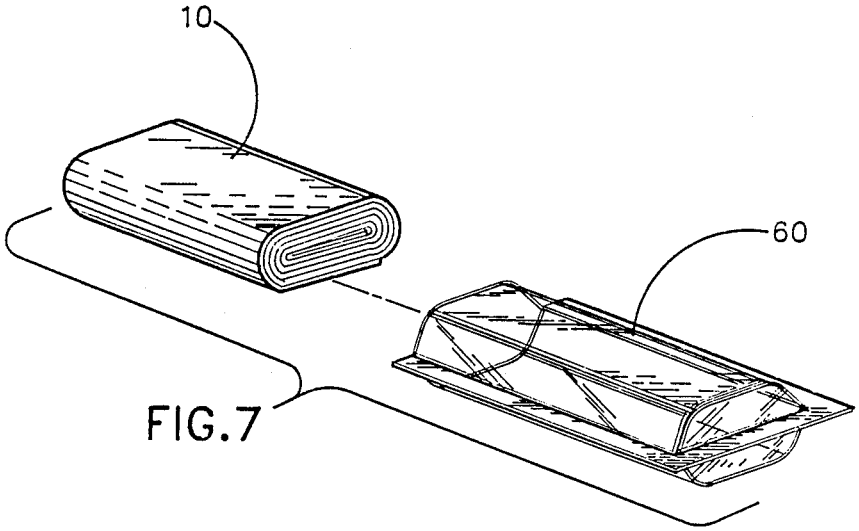
FIG. 7 is a perspective exploded view illustrating the device of FIG. 2 after it has been folded and a package for the device.

FIG. 7 illustrates a package 60 for containing a device 10 of the present invention which as been folded so that it will fit in the package.

To use the sanitary device 10 in accordance with the method of the present invention, one first removes device 10 from its package 60 and unfolds it as illustrated in FIG. 2. The device is then installed on a toilet by lowering the device onto the toilet. As the device is lowered one should make sure that the device is properly oriented with the device's rear side 38 facing the back of the toilet. The device's tails 46 should also face downwardly so that they enter the toilet bowl first. The user should also make sure that the tails contact the water in the toilet bowl.

When fully lowered, the device's seat cover 16 should be laying on toilet seat 12, and the device's bottom cover 44 should be lying on the surface of the water in the toilet bowl as best illustrated in FIGS. 8 and 9. Initially, the device will be pleated and may not be fully extended into the water as shown in FIG. 9. However, when the occupant can push it downwardly by hand before sitting on it so that the bottom cover nearly touches the water surface. When waste material is deposited in the device, contact between bottom cover 44 and the water surface is assured. The water will support bottom surface 44 and will be assisted in that support by lateral flanges or wing portions 45, as best seen in FIGS. 8 and 9. The waste material 47, when deposited in the device will cause the bottom wall 44 to displace some of the water and to curve downwardly as shown. Seat cover 16 should also be positioned on the toilet seat so that it covers the entire toilet seat. If part of the toilet seat is showing, the device should be shifted or moved about until the cover covers the entire toilet seat. As previously mentioned, it is important to cover the entire seat to prevent a toilet occupant from contacting the toilet seat.

After installing the device on the toilet, lid 50 should be checked to make certain that it's in its open position as illustrated in FIG. 1 to cover the front of the toilet bowl. If it is, the device is ready to be used. The device is used simply by sitting on it as one would sit on a uncovered toilet seat. The user or toilet occupant then discharges his or her waste matter into collecting means 18. Toilet paper used by the toilet occupant may also be deposited in the collecting means.

The user or toilet occupant then closes lid 50, as previously described, and flushes the toilet. The vortex of whirling water created by flushing the toilet will twist the device off the toilet seat, pull it into the toilet bowl and ultimately flush the device down the toilet. Accordingly, any waste matter contained in the collecting means of the device will also be flushed down the toilet. Moreover, since the toilet bowl interior will be substantially covered by the device even as the device is being twisted off the toilet seat, few, if any, bacteria and/or viruses contained in the waste material in the device and contained in the toilet bowl will be able to leave the toilet bowl interior. Those which do become air-borne in most cases, will be trapped by the device and, accordingly, flushed down the toilet with the device.

From the foregoing description, a number of significant advantages of the present invention should be readily apparent. The present invention protects an individual using the toilet from actually contacting the toilet seat and thereby prevents the individual from coming into contact with any viruses and/or bacteria on the toilet seat. In addition, and more importantly, the invention provides an imperforate barrier between the toilet bowl interior and bathroom or room in which the toilet is located, thereby substantially preventing any bacteria and/or viruses in the toilet bowl from becoming airborne when the toilet is flushed.

In order to accomplish these results, a lid is provided which serves a dual function. It is attached to the toilet cover at the front and can be pivoted downwardly in front of the toilet bowl to protect the toilet occupant and his or her clothes from rubbing against the front of the toilet bowl which may be contaminated. After use, the cover can be closed to retain viruses and bacteria that may be in the waste material from spraying out into the room during flushing of the device down the toilet. Furthermore, the container of the device is pleated or folded so that it will extend down into the bowl and has a flat bottom for contacting and being supported by the water. The bottom also has lateral flanges or wing portions 45 which help support the bottom on the water surface when waste material is deposited thereon. In addition, these flanges turn with the swirling water when the toilet is flushed and provide a torque which twists the device into a rope-like spiral so that it will readily pass through the toilet outlet.

This invention has been described in detail with reference to a particular embodiment thereof, but it will be understood that various other modifications can be effected within the spirit and scope of this invention.

I claim:

1. A sanitary human waste disposal device for installation on a toilet having a toilet seat and toilet bowl, said device comprising:

toilet seat cover means sized and configured to cover the toilet seat to prevent a toilet occupant from contacting the toilet seat, said cover means also defining a cutout center portion which is sized and configured to permit the passage of human waste discharged by the toilet occupant;

human waste collecting means sealably depending from said cutout center portion, having imperforate sides and an imperforate bottom which isolates the toilet bowl interior when said device is installed on the toilet, said sides being sized and configured so that said bottom will contact water in the toilet, said bottom having sufficient lateral extent to be supported by the water when waste is deposited therein and generally rectangular lid attached along one edge to a front portion of said cover means for movement from a first position extending down over the front of the toilet, to protect the toilet occupant from contamination on the front of the toilet, to a second closed position completely covering said cutout portion to minimize viruses and bacteria from being discharged from the waste material during flushing of the toilet.

2. A waste disposal device, as claimed in claim 1, further including:

sealing means for sealing said lid to said cover means when said lid is in said closed position so that waste contained in said collecting means is retained therein during flushing.

3. A sanitary human waste disposal device for installation on a toilet having a toilet seat and toilet bowl, said device comprising:

toilet seat cover means sized and configured to cover the toilet seat to prevent a toilet occupant from contacting the toilet seat, said cover means also defining a cutout portion which is sized and configured to permit the passage of human waste discharged by the toilet occupant;

human waste collecting means sealably depending from said cutout center portion, having imperforate sides and an imperforate bottom which isolates the toilet bowl interior when said device is installed on the toilet, said sides being pleated to facilitate expansion so that said bottom will contact water in the toilet when waste is deposited therein, said bottom having sufficient lateral extent to be supported by the water when waste is deposited therein and being generally rectangular in configuration with a front edge and a back edge; and first and second tail portions attached to said front and rear edges, respectively, of said bottom, each said tail portions extending down into the water in the toilet so as to enhance the pulling of said cover means and collecting means down into the water when the toilet is flushed, said tail means thereby enhancing flushing of said cover and said cover and said collecting means down the toilet.

4. A human waste disposal device, as claimed in claim 3, further including:

wing portions extending outwardly beyond said sides of said collecting means, said wing portions contacting water in the toilet when said bottom rests on the water so as to enhance the twisting of said device in the water by applying torque thereto when the toilet is flushed so that the device is drawn into a spiral rope like configuration as it is drawn into the water and passes through the toilet outlet.

5. A sanitary human waste disposal device for installation on a toilet having a toilet seat and toilet bowl, said device comprising:

a toilet seat cover being sized and configured to cover the toilet seat to prevent a toilet occupant from contacting the seat when the device is installed on the toilet, said seat cover defining a rectangularly shaped, centrally located cutout portion which is sized and configured to permit the passage of human waste discharged by the toilet occupant;

an imperforate, rectangularly shaped collecting means having opposed front and rear sides, opposed lateral sides and a bottom for collecting human waste discharged by the toilet occupant, said sides depending from said centrally located cutout portion so that said cover and said collecting means define an imperforate barrier which isolates the toilet bowl interior when said device is installed on the toilet, thereby insulating the toilet occupant from any bacteria and/or viruses located in the toilet bowl interior, said sides depending a predetermined distance from said cover means to enable said bottom to contact water contained in the toilet bowl so that it will support waste material deposited therein without breaking;

flanges extending laterally from opposite sides of said bottom so that, when the toilet is flushed, said flanges twist said device into a spiral rope-like configuration as the device is pulled into the water, thereby facilitating its flushing down the toilet;

a lid for covering said cutout portion after human waste has been discharged into said collecting means by the toilet occupant, said lid being generally rectangularly shaped and attached to a front portion of said cover means for movement from a first position in which it extends down the front of the toilet bowl to protect the clothes of the toilet occupant during use to a second closed position covering said cutout portion;

adhesive means located on said lid for sealing said lid to said cover means when said lid is in the closed position;

a wing portion extending outwardly from said bottom beyond each of said lateral sides, said wing portions contacting water in the toilet to enhance the twisting of the device by the swirling water when the toilet is flushed;

two tails attached to said bottom adjacent said front and rear sides, respectively, said tails being sized and configured to extend downwardly into the water to pull the device down into the water when the toilet is flushed.

* * * * *